US005224962A

United States Patent [19]

Karal et al.

[11] Patent Number: 5,224,962

[45] Date of Patent: Jul. 6, 1993

[54] METHOD AND APPARATUS FOR SUBMERSION AND INSTALLATION OF FUNDAMENT STRUCTURES ON THE SEA BOTTOM

[75] Inventors: Karel Karal, Oslo; Jan Skjong, Stabekk, both of Norway

[73] Assignee: Norwegian Contractors A.S., Stabekk, Norway

[21] Appl. No.: 857,873

[22] Filed: Mar. 26, 1992

[30] Foreign Application Priority Data

Jun. 18, 1991 [NO] Norway ..... 91.2371

[51] Int. Cl.[5] ..... B65G 5/00; E02B 17/00

[52] U.S. Cl. ..... 405/204; 405/203; 405/209; 405/210

[58] Field of Search ..... 405/203, 204, 205-207, 405/188, 224, 228, 171, 195.1, 210, 209

[56] References Cited

U.S. PATENT DOCUMENTS

| | | | |
|---|---|---|---|
| 2,021,014 | 11/1935 | Moran | 405/207 |
| 2,938,353 | 5/1960 | Vorenkamp | 405/205 X |
| 3,429,128 | 2/1969 | Stafford et al. | 405/205 X |
| 3,496,900 | 2/1970 | Mott et al. | 405/224 X |
| 3,719,048 | 3/1973 | Arne et al. | 405/205 |
| 3,738,113 | 6/1973 | Madary et al. | 405/205 X |
| 4,031,581 | 6/1977 | Baugh | 405/205 X |
| 4,733,933 | 3/1988 | Andreasson | 405/204 X |
| 4,909,671 | 3/1990 | Skjong | 405/206 |

FOREIGN PATENT DOCUMENTS

| | | |
|---|---|---|
| 965614 | 4/1975 | Canada . |
| 2159378 | 6/1972 | Fed. Rep. of Germany . |
| 160270 | 12/1988 | Norway . |
| 2083114 | 4/1982 | United Kingdom . |
| 2222190 | 2/1990 | United Kingdom . |

*Primary Examiner*—Dennis L. Taylor
*Attorney, Agent, or Firm*—Wenderoth, Lind & Ponack

[57] ABSTRACT

A method and apparatus for installation of heavy, ballastable, gravity fundament structures on the sea bottom at large depths. In accordance with the invention, there is utilized air, water, and a liquid lighter than water in various proportions and combinations to provide the structure with the required buoyancy and submerged weight during the sequential phases of the transport and descent operations in order to finally position the structure in a selected location on the sea bottom. Various modes can be used to accomplish the descent and the structure may in a final stage be penetrated down into the sea bottom to a sufficient degree.

19 Claims, 4 Drawing Sheets

METHOD AND APPARATUS FOR SUBMERSION AND INSTALLATION OF FUNDAMENT STRUCTURES ON THE SEA BOTTOM

BACKGROUND OF THE INVENTION

The present invention relates to a method and apparatus for submersion and installation of primarily heavy fundament structure on the sea bottom in connection with relatively large depths.

Submersion and accurate positioning of large fundament structures at relatively large depths, for instance more than 350 meters, are difficult to accomplish on the basis of known techniques. Large crane vessels of the type utilized for offshore operations are not designed for submerged lowering of large heavy structures to large depths, and such crane vessels have at present a limit of a depth of approx. 350 meters, and approx. 350 and 5000 tons lifted weight. If the depth exceeds 1000 meters, the weight of the hoisting cable will be so large that the effective installation weight will be rather limited. At very large depths, the entire loading capacity of the cable will be utilized in order to carry its own weight.

Several known methods and apparatus for submersion and installation of heavy structures on the sea bottom have been developed by the applicants, and are, among others, shown in U.S. Pat. No. 4,909,671 and pending application Ser. No. 745,238.

SUMMARY OF THE INVENTION

The principal object of the present invention has been to provide a solution which makes it possible, without undue expense, to carry out submersion of large structures down to the sea bottom, particularly in areas of large depths, and a solution which particularly aims at reducing the need for auxiliary equipment during the submersion and installation work, particularly the need for crane vessels.

By the method in accordance with the invention for the installation of a heavy, ballastable fundament structure on the sea bottom at a site of large depth, the structure is floated out to the installation site by its own buoyancy with a freeboard, and one first mode of the invention is generally characterized by the following steps.

Ballast or buoyancy chamber(s) in the structure are filled with air sufficient for the structure to be towed out to the installation site in a water surface position.

One or more flexible tubes of a sufficient length are connected between the chambers in the fundament structure via an equipment unit and a nearby auxiliary vessel or vessels having the necessary equipment for carrying out the submersion operation. At the installation site, the air in the structure is vacated simultaneously as a liquid lighter than water is supplied to the chambers in the structure in sufficient quantities such that the structure becomes weightless or buoyancy neutral. Simultaneously part of the water in the lower parts of the structure is expelled out of the structure into the ambient water.

A preselected quantity or volume of the liquid lighter than water is thereafter evacuated from the structure, resulting in that a corresponding volume of the ambient water will flow into the structure and replace the removed liquid lighter than water. The result is that the structure becomes heavier than water and sinks towards the sea bottom with a preselected submerged weight.

In the above outlined first mode of the method in accordance with the invention based on free descent, the sinking movement of the structure is preferably discontinued or arrested when the structure has reached a preselected small height above the sea bottom, such that the structure, by a suitable means, can be moved laterally to the exact desired position relative to the sea bottom. Afterward the structure is further ballasted in order to place the structure down on the sea bottom. Methods for accomplishing discontinuation of the descent shall be described or referred to later.

In most applications, it is desirable to penetrate the structure down into the sea bottom. To fulfill this aim, the fundament structure is, in a conventional manner provided with circumferential downwardly pointing skirts. The present invention, including utilization of a liquid lighter than water, can be utilized to accomplish a simple and effective penetration of the fundament structure down into the sea bottom.

Thus, when the structure is positioned on the sea bottom, a tube conveyor or passage extending from one or more of the cells in the structure containing the liquid lighter than water is opened up to a receptor positioned in the auxiliary vessel, resulting in that the liquid lighter than water will float from the cell or cells in the structure up to the receptor in the vessel. Simultaneously, a sub-pressure will be generated in the cell or cells and a corresponding volume of the ambient water will flow into said cell or cells and also give the gravity structure an increased weight, causing the gravity structure to penetrate down into the sea bottom.

In a second mode of the invention, the initial steps of the method will be the same up to the point where the structure is made weightless or is buoyancy neutral. From this point, the second mode differs in the following respects.

In the weightless state, the structure is again given a certain positive buoyancy by supplying an additional quantity of liquid lighter than water. Thereafter the structure is pulled down to the sea bottom by arranging a descent pulling cable extending from the structure down to an anchor preinstalled on the installation site on the sea bottom, a winch means being positioned on the sea bottom or on the structure to accomplish the pulling-down operation. In this second mode of the invention, in which a winch means is wholly or partly utilized for lowering the fundament structure, an inherent tendency of rotational movement of the structure around the descending cable is arrested by a suitable means, and the appropriate azimuth orientation is maintained by operating suitably located thrusters on the structure.

The final steps in connection with the method, i.e. the positioning of the fundament structure and the penetration of the same down into the sea bottom, will be generally the same as described in connection with the first mode of the invention.

The method in accordance with the invention is based on the physical fact that liquid fluids of different density are almost identically compressible, i.e. the ratio between the density of the liquid lighter than water and the density of water is almost constant with the submergence depth, implying that the structure would possess the same submerged weight at all submerged levels. One should note, however, that compressibility of the typical construction materials (concrete, steel) is less than that of water, which means that the buoyancy of the structure increases, and the submerged weight decreases accordingly, with increasing submergence depth. This means that in the case of free descent, the volume of the buoyancy liquid in the structure must be gradually reduced by controlled evacuation in order to maintain either a uniform descending speed or a constant winch down force. The fact that the same hydrostatic pressure will exist both on the inside of the structure and the outside thereof at all levels makes the utilization of a high pressure resistant fundament structure superfluous.

A preferred embodiment of a fundament structure to be used in connection with the method in accordance with the invention is realized as a bell-shaped or a cylindrical tank or tanks with a closed top and open bottom, and is provided with circumferential free-standing skirts adaptable for penetrating the sea bottom.

Between the ballast chamber(s) in the structure for air and liquid, and necessary equipment on an auxiliary vessel, is arranged at least one flexible tube having such a length that it may extend from the structure in its submerged position on the sea bottom to the auxiliary vessel on the sea surface. The tube terminates in a valve arrangement located on the auxiliary vessel, which provides control during evacuation of the lightweight liquid when the structure is being penetrated into the seabed. For the actual installation depth, 700 m or more, and for the density of the actual lightweight liquid, e.g. 0.7–0.8 g/cm$^3$, the static pressure in the flexible tube at the valve arrangement is high. When this pressure is reduced during the lightweight liquid evacuation, the structure penetrating into the seabed, with parts of the skirts "sealed" by the adjacent soil, can experience an external downwards oriented force resulting from the difference between ambient pressure and the reduced pressure in the lightweight liquid. As this force is a function of the pressure reduction at the valve, and can be very large, full pressure control is necessary. Evacuation of all lightweight liquid to tanks on an auxiliary vessel is a natural process that does not require artificial means such as pumping. Also, the flexible tube is emptied by gravity forces at the end of evacuation.

Often it is required to continue the penetration after withdrawal of the lightweight liquid in order to achieve a prescribed level of the structure. This is accomplished by evacuation of the water entrapped in the ballast chamber(s) by means of pump(s) contained in the equipment unit.

Between the equipment unit, a control center and a power supply on the auxiliary vessel is arranged a cluster of conduits called umbilicals, transmitting power (electric or hydraulic) signals from and to sensors and equipment in the equipment unit and facilitating the transfer of small amounts of the lightweight liquid from and to the ballast chambers, thus facilitating fine tuning of the structure's submerged weight. This is essential if the submersion is achieved by lowering by deballasting. As explained before, the buoyancy, of the structure increases with the submergence depth, and the lightweight liquid must be withdrawn from the structure to maintain a uniform descending velocity.

The temporary interruption of the submersion movement of the structure when it has reached down to the small height above the sea bottom; may be accomplished in several ways. For instance, a supporting wire can be extended from the structure up to a float with a sufficient buoyancy, floating at the sea surface. The wire has having a suitable length, so that the sinking movement is arrested when the umbilical is being stretched and subjected to a certain tension.

In replacement of the above described means for accomplishing an interruption of the sinking movement, one can utilize a system of so-called "clump weights".

Methods and equipment for carrying out a controlled submersion by ballast control and installation of heavy structures on a sea bottom are, as mentioned before, described in applicant's U.S. Pat. No. 4,909,671 and U.S. patent application Ser. No. 745,238.

Methods and apparatus for carrying out a controlled submersion by winch down systems are known per se from other applications.

Practical performance of descent operations according to both methods, i.e. free descent by controlled ballasting and the winch down method, requires a quick reduction of buoyancy, from a significant excess buoyancy essential for floating in waves, to a small fraction of the original buoyancy (a tenth or so) that remains positive (i.e. excess buoyancy) for the winch down submersion and to a negative buoyancy (i.e. the structure's weight is larger than the buoyancy acting on it) for the controlled ballasting descent. This quick reduction is achieved by release of a pre-calibrated amount of water entrapped in a dedicated chamber. Fine tuning, if necessary, is performed by withdrawal or injection of lightweight liquid through the umbilical.

For most of the practical applications of the winch down method, the descending cable is attached to an anchor point on the seabed provided by a preinstalled anchor penetrated into the seabed by suction.

The tension force in the descending cable is resisted partly by the weight of the anchor and partly by its interaction with the adjacent soil.

By utilizing the present invention, one obtains a technically feasible and, from an economical point of view, attractive solution to be used in connection with submersion and installation of particularly large fundament structures on a sea bottom, and especially in connection with relatively large depths, since such operations have hitherto necessitated large expenses and created many problems. A particular advantage in connection with the invention is that the method does not require expensive special equipment, and one avoids a need for dimensioning the fundament structure or part of the same, to sustain high hydrostatic pressures under the installation operations.

A fundament structure in accordance with the invention is preferably divided up into several chambers, and has an upper, completely closed, section, and usually at least one lower chamber or section, including a so-called skirt section able to penetrate the sea bottom and which is open to the ambient water. Thereby, the structure can be floated and towed by its own buoyancy by positioning air and/or liquid lighter than water in the upper part of the structure. Before the descent operation shall take place, the air in the structure is removed and replaced by a liquid lighter than water, and further quantities of a liquid lighter than water is supplied into the chambers in the structure simultaneously as corresponding quantities of water are expelled from the structure. Inasmuch as the structure is thus not containing air, the liquids, such as water and oil, are practically incompressible, and the chambers are open to the ambient sea, it will not be necessary to design the fundament structure with pressure resistant chambers, a fact which otherwise would lend the structure and method unacceptable for use at very large sea depths. The solution in accordance with the invention facilitates both construction and installation of fundament structures at very large sea depths, without the use of crane equipment.

BRIEF DESCRIPTION OF THE DRAWINGS

The invention shall be further described below in connection with the accompanying drawing figures illustrating the principle basis of the invention and showing embodiments of constructions in accordance with the invention, wherein.

DETAILED DESCRIPTION OF THE PREFERRED EMBODIMENTS

Figure 1:
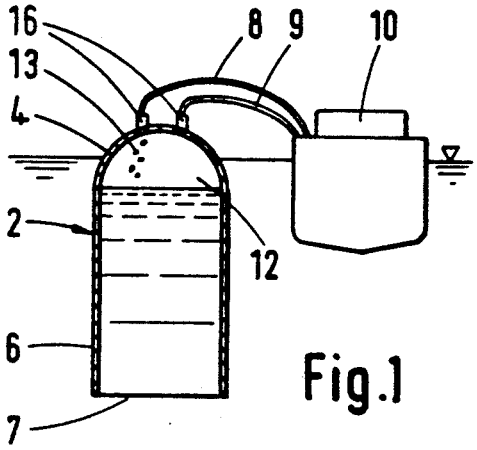
FIGS. 1–5 are sketches illustrating the principles forming the basis for the method in accordance with the invention.
Figure 2:
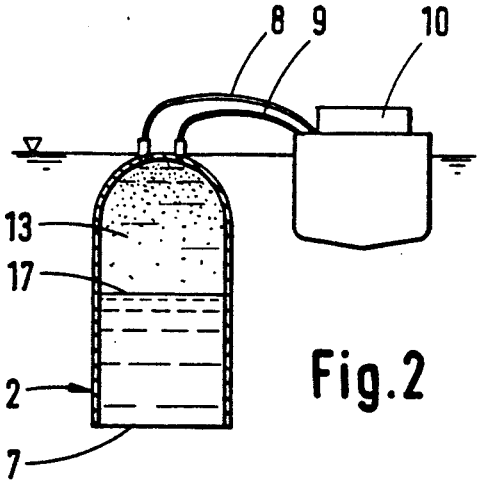

FIGS. 1–5 are sketches illustrating the physical principles which form the basis of the method according to the invention. The figures illustrate important steps or phases during the execution of the method from a position where the fundament structure is floating with a freeboard at the sea surface down to the installed position at the sea bottom. In all figures, similar reference numbers designate similar parts.

In the figures, the reference number 2 designates a floatable fundament structure 2, which in principle is realized as a bell-shaped container with a closed upper section or top 4 and a bottom section 6, shown in the embodiment with an open bottom 7. The top of the fundament is connected to a nearby auxiliary vessel 10 via one, or preferably two, flexible tubes 8 and 9. One tube is utilized, as a "drain hose" for conveying large volumes of liquid out of and into the structure. Another tube is an "umbilical" for conveying small amounts of liquid during descent, energy supply, signal and transmission cables, etc.

Figure 3:
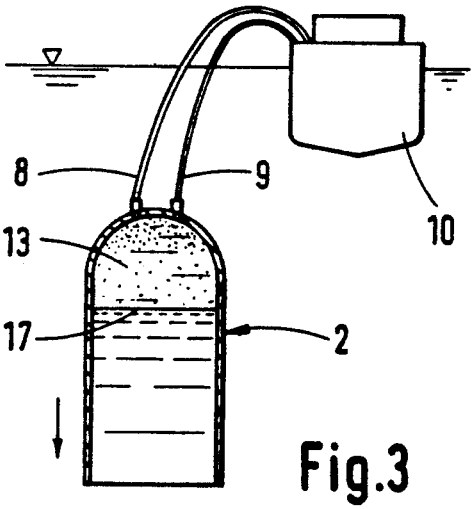

FIG. 1 illustrates a situation where the fundament 2 has been floated out to an installation site using its own buoyance, a suitable quantity of air 12 having been pumped into the upper section 4 of the structure. The tubes 8 and 9 are connected to operational equipment mounted on the auxiliary vessel 10. In this situation, the descent of the fundament may be initiated. Air is evacuated from the fundament, simultaneously as a liquid lighter than water, for instance oil, is pumped into the fundament via the tube 8 in such suitable quantities so that the fundament is floating at the sea surface with a steadily reduced freeboard. At the end of this procedure, one arrives at the situation illustrated in FIG. 2, at which all or substantially all air has been evacuated and the upper section 4 of the fundament contains sufficient quantities of liquid lighter than water, designated with the number 13, so that the fundament hoversdweightlessly at the sea surface, i.e. is buoyancy neutral. When the descent operation is initiated, a suitable part of the liquid is transported or returned to the auxiliary vessel via the tube 9, simultaneously as a corresponding volume of water will then enter into the lower section of the fundament through the open bottom 7. Since water and oil are immiscible, a boundary layer will at all times exist between the liquid and the water in the fundament structure. The structure will now descend towards the sea bottom with uniform velocity, which velocity is defined by the weight of the fundament structure. In other words, the greater amount of the liquid which is returned to the vessel and thereby replaced with water, the heavier will be the fundament structure and the greater will be the descending velocity. This phase is illustrated in FIG. 3. At this point it shall be noted that the tubes 8 and 9 have a sufficient length to maintain the connection with the fundament all the way down to the installation site on the sea bottom. And inasmuch as a liquid such as oil is not compressible, for all practical purposes, the structure will have a constant weight at all water depths contrary to the case in connection with an open chamber filled with air, which will attain a decreasing volume with increasing depth. Thus the fundament structure can be ballasted and lowered down on to the sea bottom and be installed on the same at very large depths without the use of crane vessels and the like, and further, the fundament does not need to be made particularly pressure resistant, since the pressure inside the fundament and in the ambient sea will be practically the same at all depths.

Figure 4:
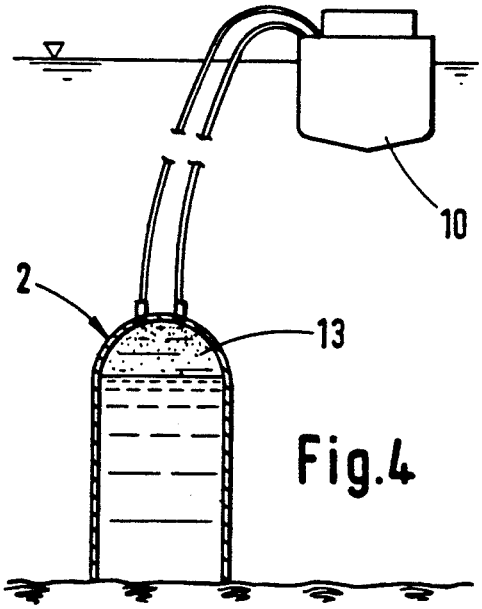
Figure 5:
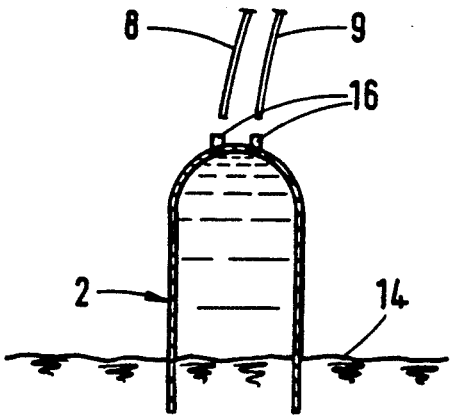

When the fundament has been lowered almost down to the sea bottom, it is, as a rule, desirable to interrupt the sinking movement in order to impart to the fundament a controlled lateral movement until it has reached a position directly above the exact installation site on the sea bottom. The interruption step of the sinking procedure is not illustrated in the sketches, but can be carried out by means of various known methods, for instance as proposed in applicant's U.S. Pat. No. 4,909,671, or U.S. patent application Ser. No. 745,238, i.e. either by using floating buoys and/or by using so-called "clump weights". When the fundament has reached the desired lateral position, the fundament is further ballasted, for instance by removing the descent interruption means or by evacuating a further part of the remaining liquid 13, resulting in that the fundament is seated down on to the sea bottom as illustrated in FIG. 4. In this position, the hose 8 for supplying and removing liquid lighter than water from the fundament to the auxiliary vessel is opened above sea level, with the result that the remaining part of the liquid will rise or ascend up to the sea surface due to its weight being lighter than water. Simultaneously, provided the bottom circumferential skirt on the fundament has penetrated somewhat into the sea bottom, a hydrostatic pressure difference will be created between the inside and the outside of the fundament, forming a vacuum or sub-pressure inside the fundament, a fact which leads to the fundament structure—depending on the properties of the sea bottom—penetrating down into the sea bottom along the skirts 14, as illustrated in FIG. 5. The weight of the structure will, in reality, increase when liquid is removed and replaced by water, and contributes to the penetration of the structure down into the sea bottom. When the desired penetration depth of the skirts 14 has been reached, the removal of the remaining liquid is discontinued by closing off a valve 16 on the top side of the fundament, whereafter the tube or tubes 8 and 9 may be removed, and whereafter the fundament is ready to be used in accordance with the task involved. As a rule, all liquid is withdrawn, and additional penetration is achieved by pumping the water out of the fundament.

Figure 6:
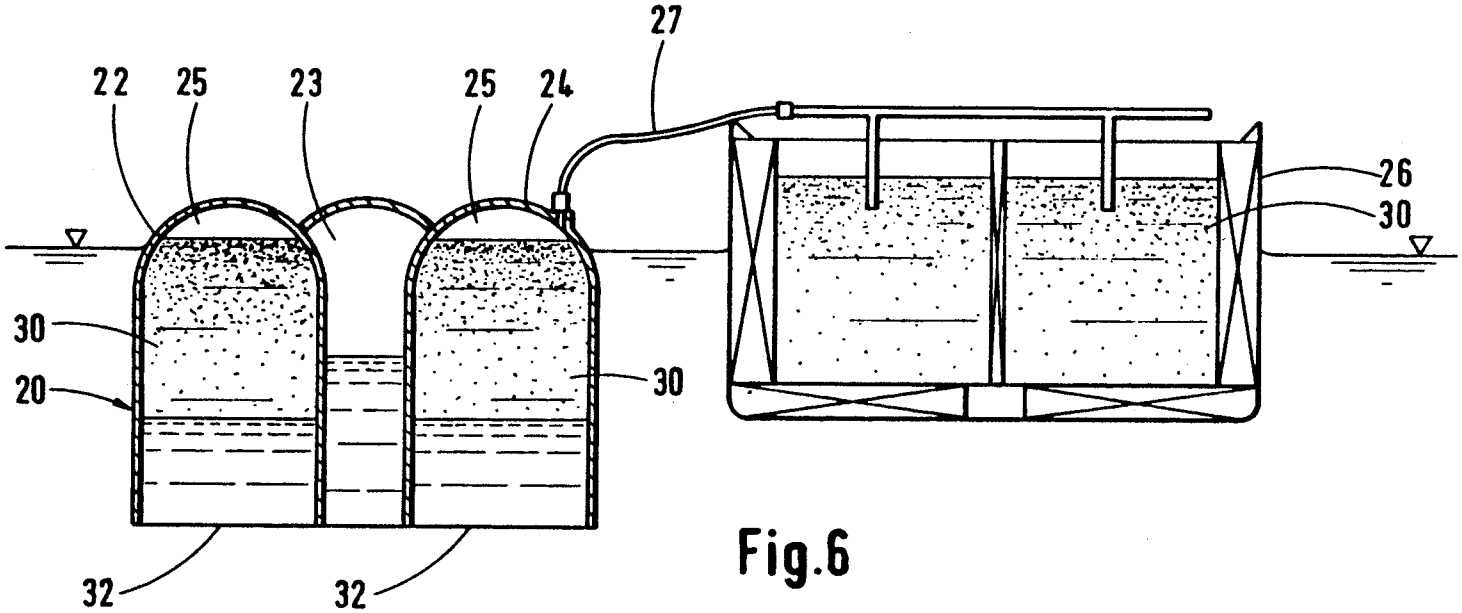
FIG. 6 shows a fundament structure in accordance with the present invention, herein shown in a water surface position side-by-side with an auxiliary vessel.
Figure 7:
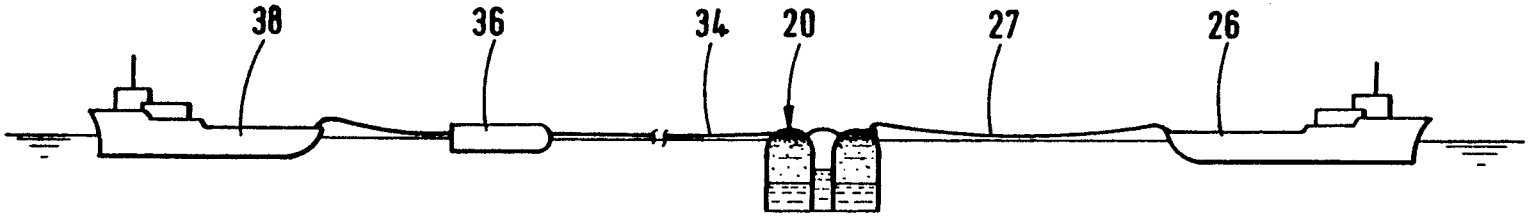
FIG. 7 is a lateral view on a smaller scale illustrating the situation when submersion of the fundament structure may be initiated.
Figure 8:
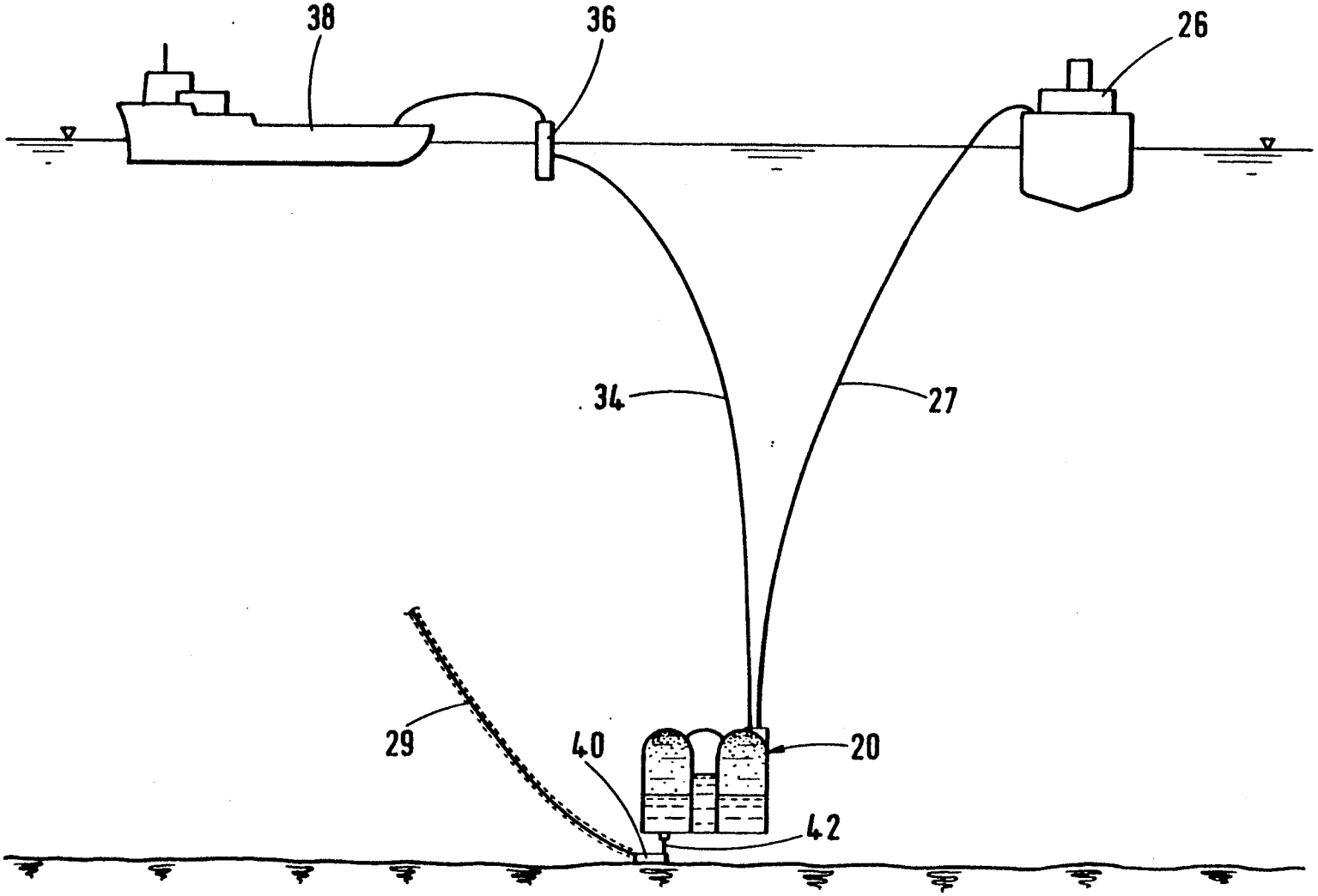
FIG. 8 is a view similar to FIG. 7 illustrating the situation when a descending movement by controlled ballasting of the fundament structure has been temporarily discontinued at a small height above the sea bottom by suitable mean.

The principles in accordance with the invention may be realized with various types of fundaments, as long as these fulfill the necessary requirements. FIGS. 6–8 illustrate one practical embodiment for a fundament structure, including necessary auxiliary equipment, and in which figures the same reference numbers in all figures designate the same parts. The number 20 designates a fundament structure especially adapted to be used with the method in accordance with the invention. The fundament comprises here two mutually spaced, integral parts or sections 22 and 24, and a relatively small center chamber 23 arranged therebetween, having a known height and volume. The center chamber 23 has a closed top and is open downwards. The size of this center chamber is, in the figures, enlarged for the sake of clarity. By measuring the height of the liquid column, the weight of the entire fundament structure at any time during the operations can be stipulated prior to the descent being initiated. In the position or step illustrated in FIG. 6, the sections 22 and 24 of the fundament each contains an air volume 25 as shown in the upper parts of the sections 22 and 24, so that the fundament floats with a freeboard. The chambers or internal space of the fundament is connected to an auxiliary vessel 26 via at least one tube 27 leading to each chamber (only one is shown). Liquid 30, lighter than water, for instance oil, is pumped from the auxiliary vessel 26 into the fundament chambers simultaneously as air, in a controlled fashion, is evacuated until the fundament is weightless or buoyancy neutral.

In order to initiate the submersion or descent of the fundament, the fundament is ballasted to a desired degree by removing a suitable part of the liquid volume 30 simultaneously as a corresponding volume of water is supplied or will enter into the fundament via the open sections 32, having the effect that the entire fundament will sink towards the sea bottom with a preselected, uniform velocity, inasmuch as the air is now entirely evacuated, and due to the fact that water and the liquid used are not compressible. By measuring the velocity down through the water and the ballasting/deballasting situation, the descent operation can be fully controlled from the auxiliary vessel via the tubes 27.

The entire fundament structure can in this fashion be seated in a controlled manner down on the sea bottom. In most cases, however, it will be desirable to move the fundament somewhat laterally in order to place the same exactly on the preselected site on the sea bottom. When the fundament, therefore, has reached a small height or distance above the sea bottom, the downward movement is interrupted, for instance by a means such as is chematically illustrated in FIG. 7. As shown, the fundament 20, is by means of a flexible tube 34, connected to a floating body 36, which is further connected via a tube to a second auxiliary vessel 38 intended to receive a large amount of liquid. The tube or a suspending cable with suitable control, has such variable length so that the sinking movement of the fundament structure can be interrupted at a desired height above the sea level (not shown, see applicant's U.S. Pat. No. 4,909,671).

FIG. 8 illustrates the next step in the sinking operation. Instead of, or in addition to, one floating body 36 with a flexible tube or drain hose 34, the fundament is, at the bottom, provided with a plurality of so-called "clump weights" 40, which are suspended from the underside of the fundament via chains 42 or the like. When these clump weights hit and come to rest on the sea bottom during the sinking movement of the fundament, the sinking movement will be arrested due to the resulting reduced weight of the fundaments. Methods and systems in connection with clump weights are, among others shown in applicant's pending U.S. patent application Ser. No. 745,238. Each of the clump weights is provided with a guiding cable 29, leading up to an auxiliary vessel on the sea surface (not shown). By lateral pulling of the clump weights via the guide cables 29, the fundament structure can be laterally displaced in an accurate fashion. Instead of, or in addition to, the use of auxiliary vessels, one may depending upon the sea depth, alternatively utilize so-called ROVs (Remote Operated Vehicles). When the fundament structure has attained the desired position above the sea bottom, it is further ballasted in a suitable fashion, usually by evacuating a further part of the liquid lighter than water in the fundament structure.

As previously mentioned, the liquid will, due to its weight lighter than water, ascend up to the sea surface via a tube or tubes 34, from where it can again be loaded aboard tanks in an auxiliary vessel 38.

When the fundament structure is finally positioned on the sea bottom, as illustrated in FIG. 5, it will, during the ascent and removal of the liquid, penetrate down into the sea bottom due to the vacuum or sub-pressure which will thereby be created inside the fundament. If the sea bottom is unusually soft, the penetration may be limited to a desired degree by discontinuing the removal of the remaining part of the liquid in the fundament. The tube or tubes are removed when valves on top of the fundament have been closed off. Thereby the fundament structure is ready to be used for its purpose, for instance for carrying above-sea or subsea constructions to be used in connection with petroleum exploitation on or in the sea bottom.

FIGS. 9*a–e* illustrate schematically the means to carry out the second mode of the method in accordance with the invention. As described before, the fundament structure is floated from a shore location out to the installation site using its own buoyancy by supplying air into the chambers in the upper sections of the structure.

Figure 9A:
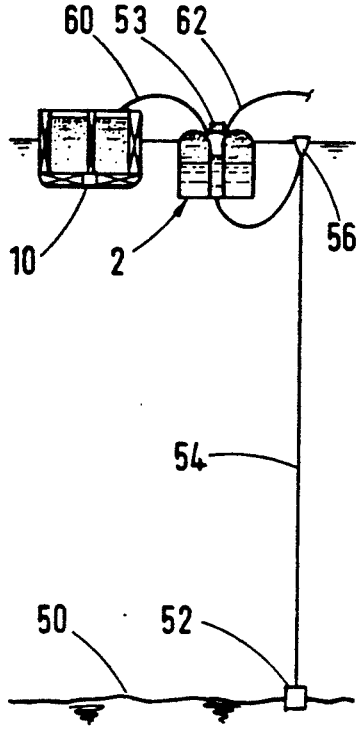
FIGS. 9*a–e* schematically illustrate an embodiment of the invention whereby the descent of the fundament structure is accomplished by utilizing a winch pulling the fundament structure down to the sea bottom.

In FIGS. 9*a–e*, the fundament structure 2 is the same or similar to the one described before, and the same applies to the auxiliary vessel or vessels 10 and 26 (see FIG. 9*b* and 9*d*), which vessels are provided with necessary auxiliary equipment such as pumps, winches and tanks, and with necessary tubular liquid conveyors or drain hoses 60 extending between the fundament structure 2 and reservoirs for a liquid lighter than water in the vessel 10, as illustrated in FIG. 9*a*.

On the installation site, before the descent of the fundament structure can be initiated, is in the sea bottom 50, pre-installed a fixed anchor 52, to which is connected a descending or pulling cable 54. Initially, preferably the cable 54 extends up to a mooring buoy 56, from which extends a pilot line to a pulling winch 53 mounted on the fundament structure 2. Between the fundament structure 2 and the auxiliary vessel 26 extend also one or more so-called control umbilicals 62. Instead of mounting the winch on the fundament structure, a pulling winch can be installed on the sea bottom in connection with the anchor 52 in order to pull the fundament structure down to the sea bottom or down to a small elevation above the sea bottom.

During this operation, the fundament structure is provided with a small positive buoyancy by removing the remainder of the air and replacing the same with a suitable quantity of liquid lighter than water simultaneously as some of the water in the fundament structure is expelled out into the ambient water.

Figure 9B:
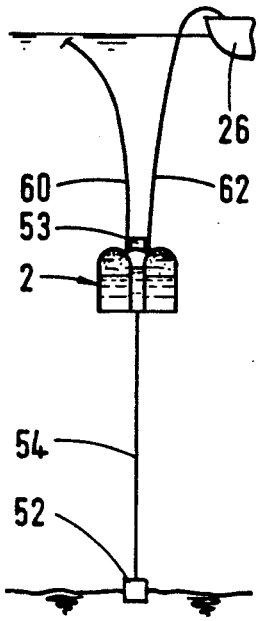
Figure 9C:
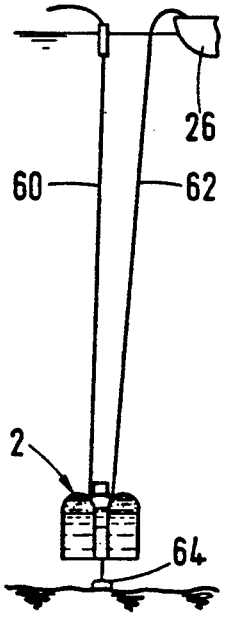

In this situation, the descent operation of the fundament structure takes place as illustrated in FIG. 9*b*, by starting the winch and thereby winching the fundament structure down, simultaneously the length of the connections 60 and 62 extending to the vessels 10 and 26, respectively, are suitably extended. When the fundament structure 2 has reached a level closely above the sea bottom as shown in FIG. 9*c*, the winchdown operation is discontinued. The final descent and positioning of the fundament structure can suitably be carried out by utilizing a clump weight system 64 as descried in applicant's U.S. patent application Ser. No. 745,238, filed Aug. 14, 1991. Such clump weights 64 are suspended on the fundament structure, preferably before the structure is floated out from a shore location. Alternatively, the fundament structure can be guided down to a position on the sea bottom by utilizing a buoy system as described in applicant's U.S. Pat. No. 4,909,671.

Figure 9D:
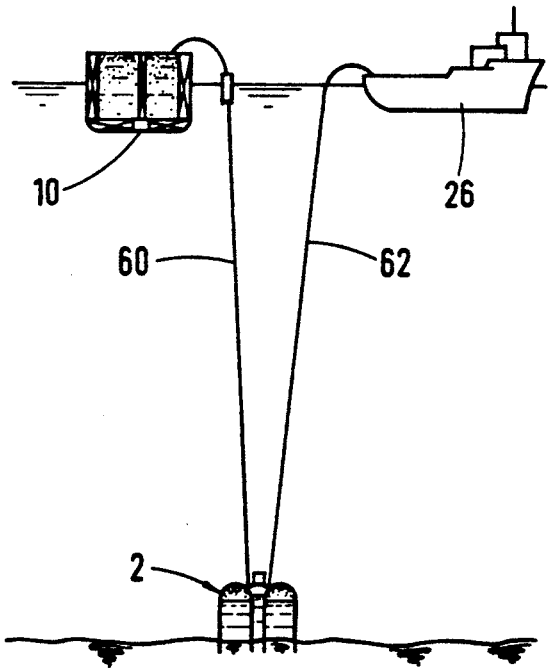
Figure 9E:
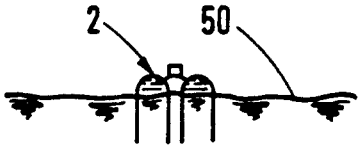

When the fundament structure has been seated on the sea bottom, as shown in FIG. 9*d*, a penetration of the same into the sea bottom can be carried out in the same way as described in connection with the first mode of the method in accordance with the invention. This phase of the descent operation is illustrated in FIG. 9*d*, during which the remainder of the liquid lighter than water is allowed to float up from the chambers in the fundament structure 2 into reservoirs in the auxiliary vessel 10, simultaneously as corresponding quantities of ambient water is allowed to float into the fundament structure. This results in the weight of the fundament increasing simultaneously as the pressure in the fundament becomes lower than the ambient water, causing the fundament structure to be penetrated down into the sea bottom. A remaining quantity of liquid lighter that water in the system can be pumped up simultaneously as a further sub-pressure is created in the fundament structure, resulting in a further penetration of the fundament structure down into the sea bottom, as if illustrated in FIG. 9*e*. As shown, all connections to the water surface have now been removed, such that the fundament structure is ready to serve its actual purpose.

Practical performance of the descent according to both described modes of the method, i.e. the free descent by controlled ballasting and the winch down, requires a quick reduction of buoyancy from a significant excess buoyancy essential for floating in waves to a small fraction of the original buoyancy (a tenth or so) that remains positive (i.e. excess buoyancy,) for the winchdown submersion, and to a negative buoyancy (i.e. the construction's weight is larger than the buoyancy acting on it) for the controlled ballasting descent. This quick reduction is achieved by release of a pre-calibrated amount of water entrapped in a dedicated chamber. Fine tuning, if necessary, is performed by withdrawal or injection of lightweight liquid through the umbilical.

It will be understood that many modifications can be carried out within the scope of the invention such as defined in the claims.

We claim:

1. A method of installing fundament structures on the sea bottom, comprising:

providing a fundament structure having at least one confined cell therein open to the ambient sea at a lower end thereof;

bringing the fundament structure to an upright floating position and towing the fundament structure to an installation side by its own buoyance by filling the at least one confined cell with a quantity of air sufficient to tow the fundament structure with a freeboard; and ballasting the fundament structure at the installation side in order to submerge and lower the fundament structure down to a selected location on the sea bottom, said step of ballasting the fundament structure including providing an auxiliary vessel, connecting at least one flexible tube between the at least one confined cell of the fundament structure and the auxiliary vessel, replacing the air in the at least one confined cell of the fundament structure with a sufficient quantity of a liquid lighter than water in order to bring the fundament structure into a substantially neutral buoyancy condition, and subjecting the fundament structure to a downwardly directed force such that the fundament structure is lowered to the selected location on the sea bottom.

2. The method of claim 1, wherein said step of subjecting the fundament structure to a downwardly directed force comprises removing a portion of the liquid lighter than water through the flexible tube, allowing a corresponding quantity of water to enter the fundament structure and resulting in the fundament structure acquiring a weight heavier than water, whereby the fundament structure sinks toward the sea bottom with a substantially uniform velocity, and further comprises actively adjusting the buoyancy of the fundament structure through the flexible tube to control the sinking of the fundament structure while the fundament structure is subjected to the downwardly directed force.

3. The method of claim 2, wherein:

the downward movement of the fundament structure is interrupted when the fundament structure reaches a predetermined distance above the sea bottom;

the fundament structure is displaced laterally to an exact portion above the selected location on the sea bottom; and the fundament structure is further ballasted to lower and seat the fundament structure on the sea bottom.

4. The method of claim 3, wherein the at least one flexible tube is opened to the atmosphere when the fundament structure is seated on the sea bottom such that the remaining liquid lighter than water in the at least one confined cell of the fundament structure ascends up to the sea surface through the at least one flexible tube, causing a pressure difference to be created between the at least one confined cell inside the fundament structure and the ambient sea, which pressure difference thus generates a vacuum in the fundament structure and tends to cause the fundament structure to penetrate down into the sea bottom.

5. The method of claim 4, wherein the at least one flexible tube is closed off when the fundament structure has penetrated down to a desired depth in the sea bottom.

6. The method of claim 4, wherein the auxiliary vessel has a pump thereon, the pump pumping at least one of the remaining liquid lighter than water in the at least one confined cell and water in the at least one confined cell from the at least one confined cell to increase the depth of penetration of the fundament structure in the sea bottom.

7. The method of claim 3, wherein the downward movement of the fundament structure is interrupted by using a system of weights suspended on the underside of the fundament structure such that the system of weight comes into contact with the sea bottom prior to the fundament structure so that the effective weigh of the fundament structure is reduced sufficiently to discontinue the downward movement.

8. The method of claim 7, wherein the fundament structure is displaced laterally by at least one auxiliary vessel, the at least one auxiliary vessel being at least indirectly connected with the fundament structure.

9. The method of claim 3, wherein the downward movement of the fundament structure is interrupted by using a floating body located on the sea surface that is connected with the fundament structure by a supporting cable having a predetermined length suitable for stopping the fundament structure the predetermined distance above the sea bottom.

10. The method of claim 3, wherein the fundament structure is displaced laterally by at least one auxiliary vessel, the at least one auxiliary vessel being at least indirectly connected with the fundament structure.

11. The method of claim 2, wherein the at least one flexible tube is opened to the atmosphere when the fundament structure is seated on the sea bottom such that the remaining liquid lighter than water in the at least one confined cell of the fundament structure ascends up to the sea surface through the at least one flexible tube, causing a pressure difference to be created between the at least one confined cell inside the fundament structure and the ambient sea, which pressure difference thus generates a vacuum in the fundament structure and tends to cause the fundament structure to penetrate down in the sea bottom.

12. The method of claim 11, wherein the at least one flexible tube is closed off when the fundament structure has penetrated down to a desired depth in the sea bottom.

13. The method of claim 11, wherein the auxiliary vessel has a pump thereon, the pump pumping at least one of the remaining liquid lighter than water in the at least one confined cell and water in the at least one confined cell from the at least one confined cell to increase the depth of penetration of the fundament structure in the sea bottom.

14. The method of claim 1, wherein each closed cell of the fundament structure is provided with a closed top section and a bottom section open to the ambient sea.

15. The method of claim 14, wherein the fundament structure is provided with downwardly directed skits along the lower end thereof, the skirts being adapted for penetrating the sea bottom.

16. The method of claim 14, wherein the fundament structure has at least two integrally assembled confined cells disposed side by side.

17. The method of claim 14, wherein the fundament structure is provided with a supplementary cell having a closed top and a bottom open to the ambient sea, the supplementary cell being adapted to be filled with air and having a known and predetermined height and volume, and wherein the total weight of the fundament structure is calculated on the basis of the height of the water in the supplementary cell.

18. The method of claim 1, wherein the step of ballasting further comprises:

supplying the structure with a preselected quantity of liquid lighter than water such that the fundament structure achieves a limited and predetermined positive buoyancy after the fundament structure is brought into the substantially neutral buoyancy condition; and in order to subject the fundament structure to the downwardly directed force, installing an anchor at the selected location on the sea bottom, connecting a pulling cable between the anchor and the floating fundament structure, connecting a winch to the pulling cable, actuating the winch so that the fundament structure is pulled downwards and descends towards the sea bottom, stopping the winch to discontinue the decent of the fundament structure when the fundament structure has reached a predetermined position above the sea bottom, and ballasting the fundament structure by removing the liquid lighter than water though the at least one flexible tube extending to the auxiliary vessel and replacing the liquid lighter than water with ambient water, whereby the fundament structure is seated on the sea bottom with a tendency toward penetrating the sea bottom.

19. A method of penetrating a structure into the sea bed having at least one confined cell therein in communication with the ambient sea and being positioned on the sea bottom, said method comprising the steps of:

filling the at least one confined cell in the structure partly with water and partly with a liquid lighter than water before lowering the structure from a position on the surface of the sea to a position on the sea bottom, the structure being provided with at least one tube extending between that at least one cell and an auxiliary vessel on the surface of the sea; and after the structure has been positioned on the sea bottom, opening the at least one tube such that the at least one cell is communicated with a receptor on the auxiliary vessel such that the liquid lighter than water floats from the at least one cell up to the receptor, thereby generating a lower pressure condition in the at least one cell and causing the structure to penetrate down into the sea bed.

* * * * *